United States Patent [19]

Peschka et al.

[11] Patent Number: 5,056,991

[45] Date of Patent: Oct. 15, 1991

[54] CRYOGAS PUMP

[75] Inventors: Walter Peschka, Sindelfingen; Gottfried Schneider, Stuttgart, both of Fed. Rep. of Germany

[73] Assignee: Deutsche Forschungsanstalt fuer Luft- und Raumfahrt e.v., Fed. Rep. of Germany

[21] Appl. No.: 491,041

[22] Filed: Mar. 8, 1990

[30] Foreign Application Priority Data

Mar. 10, 1989 [DE] Fed. Rep. of Germany ..... 3907728

[51] Int. Cl.[5] ..... F25B 9/00

[52] U.S. Cl. ..... 417/439; 417/901; 62/50.6; 62/505

[58] Field of Search ..... 417/439, 901; 62/6, 62/50.6, 505

[56] References Cited

U.S. PATENT DOCUMENTS

| | | | |
|---|---|---|---|
| 2,440,216 | 4/1948 | Anderson | 417/901 X |
| 3,640,082 | 2/1972 | Dehne | 417/439 X |
| 4,396,362 | 8/1983 | Thompson et al. | 417/439 |
| 4,817,390 | 4/1989 | Suganami et al. | 417/439 X |
| 4,911,618 | 3/1990 | Suganami et al. | 417/439 |

FOREIGN PATENT DOCUMENTS

| | | |
|---|---|---|
| 1932658 | 2/1966 | Fed. Rep. of Germany . |
| 2731805 | 1/1978 | Fed. Rep. of Germany . |

*Primary Examiner*—John Rivell

*Attorney, Agent, or Firm*—Barry R. Lipsitz

[57] ABSTRACT

To improve a cryogas pump, in particular a cryogas pump for cryogenic hydrogen fit for use in vehicles, comprising a cylinder housing and a piston which forms with the cylinder housing a first compression space for the cryogenic gas and which is mounted with a first piston section adjacent to the first compression space by a gas film in the cylinder housing such that owing to its dimensions it can be constructed so as to be fit for use in vehicles, with the shorter piston length requiring less cooling of the piston by the gas film, it is proposed that the cryogas pump comprise a second compression space with which the gas film is in communication and by means of which a flow of gas can be generated in the gas film in the direction of the first compression space.

20 Claims, 3 Drawing Sheets

CRYOGAS PUMP

Figure 1:
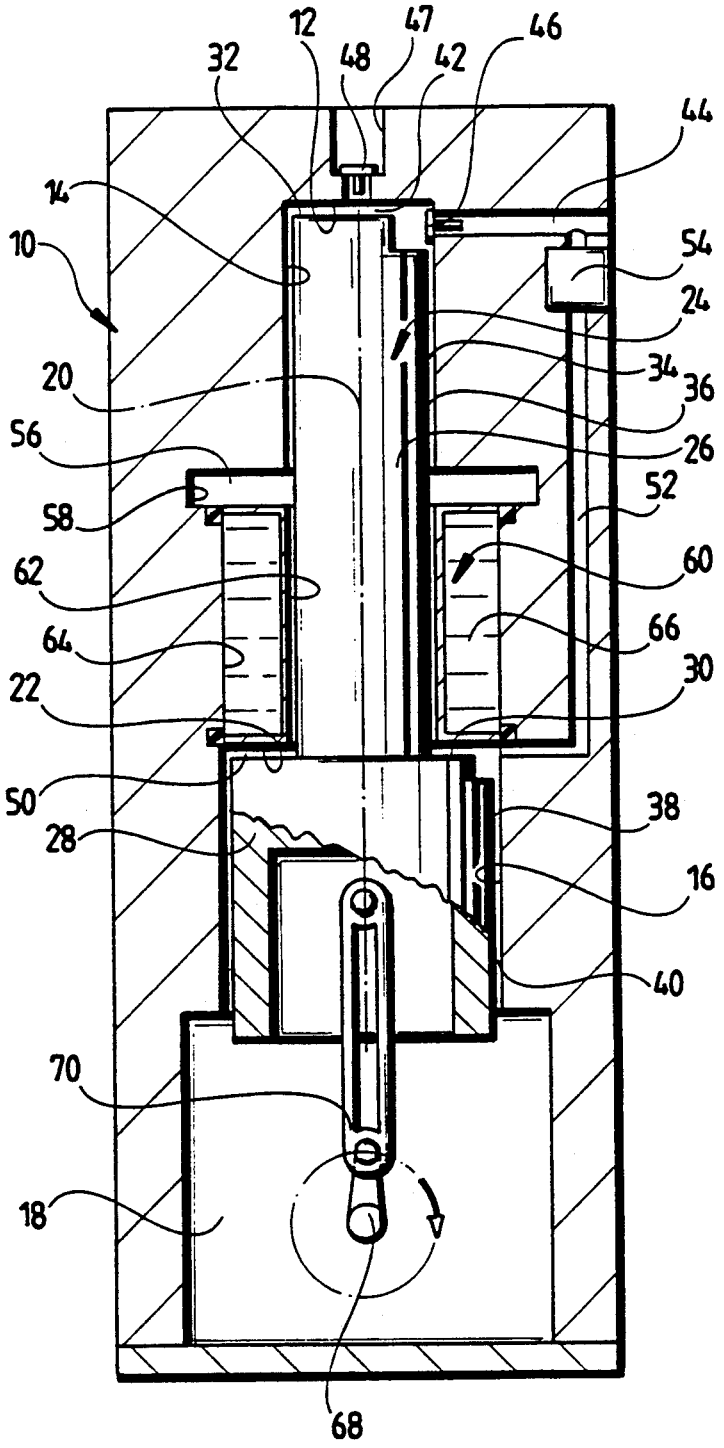

The invention relates to a cryogas pump, in particular a cryogas pump for cryogenic hydrogen fit for use in vehicles, comprising a cylinder housing and a piston which forms with the cylinder housing a first compression space for the cryogenic gas and which is mounted with a first piston section adjacent to the first compression space by a gas film in the cylinder housing.

With cryogas pumps fit for use in vehicles, the quantities delivered are usually of the order of magnitude of 3 l/min., which results in substantially smaller dimensions than in conventional cryogas pumps known so far wherein the quantity delivered is approximately ten times that of the cryogas pumps fit for use in vehicles.

This creates a large number of problems. In particular, the hitherto conventional types of sealing between the piston and the cylinder housing cannot be transferred to such cryogas pumps fit for use in vehicles.

The common use of piston packings with dry operating characteristics, for example, has the disadvantage that frictional heat is generated and causes an increase in vapor formation during operation of the cryogas pump, which has a very adverse effect on the small quantities delivered. Pumps having pistons which are mounted by a gas film, thereby eliminating the occurrence of frictional heat, are known. However, the slight radial play required therefor is practically impossible to maintain within the desired narrow limits, owing to the small piston diameters, in pumps fit for use in vehicles. In addition, the cryogas pumps with a piston mounted by a gas film have pistons with very long dimensions, for example, of the order of 700 mm, which results from the fact that, on the one hand, the drive means of the piston should be at as high a temperature as possible, for example, room temperature, while the compression space should be at the usual temperature for the cryogas, in the case of hydrogen of the order of magnitude of 30K, and that, on the other hand, cooling of the piston by the gas film always occurs over a considerable range of its length and so the above-mentioned requirements can only be met with pistons of correspondingly long design.

Pistons of such design are, however, unacceptable in a cryogas pump fit for use in vehicles merely on account of the size of the pump determined thereby. In addition, narrow tolerances for the thickness of the gas film cannot be adhered to owing to the small dimensions resulting from the small quantity delivered and so in pumps fit for use in vehicles, the cooling of the piston by the gas film is even more intensive, particularly if the cryogas pump is to operate at temperatures near that of the liquid hydrogen.

The object underlying the invention is, therefore, to so improve a cryogas pump of the generic kind that owing to its dimensions it can be constructed so as to be fit for use in vehicles, with the shorter piston length making it necessary for the piston to be cooled by the gas film to a lesser extent.

This object is accomplished in accordance with the invention in a cryogas pump of the kind described at the beginning by the pump having a second compression space with which the gas film is in communication and by means of which a flow of gas can be generated in the gas film in the direction of the first compression space.

With the inventive solution, the cooling of the piston is reduced by a flow of gas being generated in the gas film in the direction of the first compression space so the cold cryogenic gas can no longer flow away from the first compression space in the gas film and thereby cool the piston. On the contrary, the flow of gas is reversed in the gas film so cooling of the piston is only possible in its regions adjacent to the first compression space.

It is particularly advantageous for the gas film to have a temperature above 200K in the section thereof facing away from the first compression space. This ensures that there can be ambient temperature, i.e., for example, room temperature, in the region of a drive means for the piston.

In the embodiments mentioned above, it was not determined whether the flow of gas is to be generated during compression or expansion of the first compression space. It is particularly advantageous for the flow of gas to be generated at least during compression of the first compression space as a flow of gas is then generated in the phase in which primarily a cooling flow of gas in the gas film occurs away from the first compression space. It may be additionally advantageous for the flow of gas to also be maintained during expansion of the first compression space.

In the embodiments mentioned above, a second cylinder housing and a second piston may, in principle, be provided for formation of the second compression space.

To achieve a compact structural design for the inventive cryogas pump, it is, however, most advantageous for the piston to have a first piston section for formation of the first compression space and a second piston section for formation of the second compression space.

Such a concept is then easiest to implement by the piston being designed as a stepped piston and the cylinder housing having corresponding cylinder bores.

Since at high piston speed, in contrast with low piston speed, the flow of gas differs in size in the gas film and thus at high piston speed it is not possible for the entire gas compressed in the second compression space to flow off via the gas film in each pumping cycle, it is advantageous for the gas film to be provided with a buffer volume in which pressure can be built up during a compression motion of the piston and reduced during an expansion motion.

It has proven particularly expedient for the buffer volume to be formed by a ring space surrounding the first piston section.

To ensure that the gas film has a sufficiently high temperature in its section facing away from the first compression space, provision is advantageously made for the gas for the gas film to be capable of being warmed up.

The simplest possibility is for the gas film to be heatable.

To this end, provision is made in a preferred embodiment for the gas film to be heatable in the section thereof facing the second compression space.

In particular, in embodiments including a buffer volume, provision is expediently made for the gas film to be heatable between the second compression space and the buffer volume so the buffer volume simultaneously serves as heat buffer between the heated and the unheated section of the gas film facing the first compression space and hence the heat input in the second compression space is minimized.

In order to prevent, at all events, occurrence of a flow of gas in the gas film away from the first compression space, a third compression space is provided as a precompression space for the second compression space so the gas in the second compression space is always at a minimum pressure.

For reasons of compactness, it is also advantageous for the piston to have a third piston section which together with the cylinder housing forms the third compression space.

To this end, provision is made in an expedient design for the first and second piston sections to be arranged at opposite ends of the piston.

In particular, for avoidance of tilting of the piston, it has proven extremely expedient for a piston drive means to engage the piston between the first and third piston sections so the piston is mounted on both sides of the point of engagement of the piston drive means. The simplest possibility of driving the piston is for the piston drive means to comprise an eccentric.

To enable driving of the piston without a connecting rod and hence construction of the inventive cryogas pump as compactly as possible, provision is advantageously made for an eccentric pin to engage an eccentric recess extending transversely to the direction of motion of the piston.

As mentioned at the beginning, the piston is mounted by a gas film at least in the piston section thereof adjacent to the first compression space. In a preferred embodiment of the inventive cryogas pump, provision is also made for the piston to be mounted by a gas film between the second compression space and the third compression space, i.e., for the entire piston to be mounted by a gas film.

Alternatively, it is, however, also possible for the piston to be mounted by piston packings with dry operating characteristics between the second and third compression spaces so there is only one mounting of the piston by a gas film adjacent to the first compression space. This is made possible by the flow of gas in the gas film adjacent to the first compression space enabling the piston to be kept at a warm temperature suitable for conventional bearing and lubricating conditions over a relatively short distance.

Further features and advantages of the invention are to be found in the following description and the appended drawings of several embodiments. The drawings show:

FIG. 1 a section through a first embodiment of a cryogas pump; and

Figure 2:
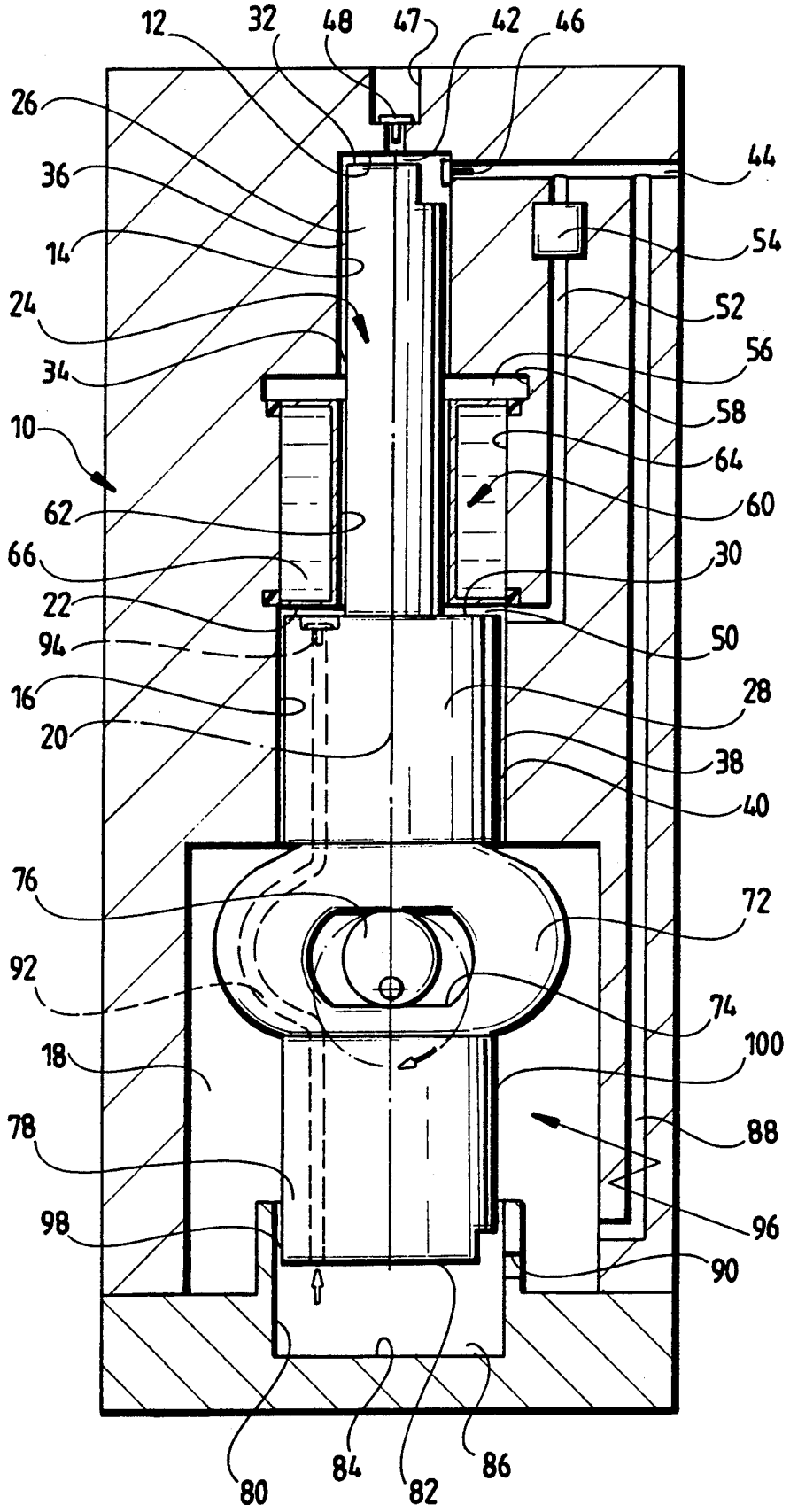

FIG. 2 a section through a second embodiment of a cryogas pump.

Figure 3:
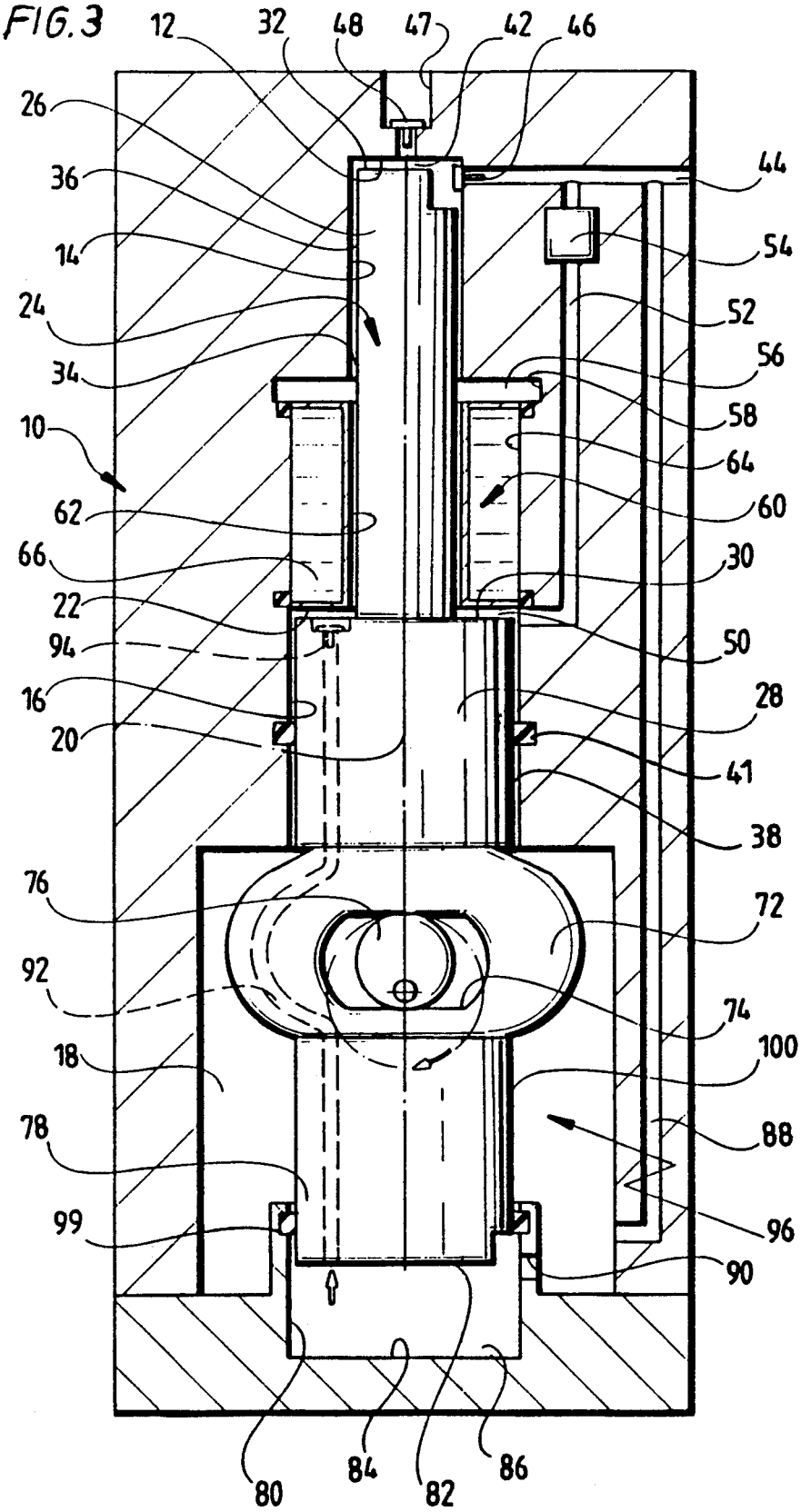

FIG. 3 a section through an alternative of the second embodiment having piston packings.

A first embodiment of the inventive cryogas pump, illustrated in FIG. 1, comprises a cylinder housing 10 with a first cylinder bore 14 which is closed off by a cylinder bottom 12. Adjoining the first cylinder bore 14 on the side opposite the cylinder bottom 12 is a coaxial second cylinder bore 16 having a larger diameter than the first cylinder bore 14 and extending as far as a crankshaft space 18.

A ring surface 22 extending from the first cylinder bore 14 to the second cylinder bore 16 perpendicularly to a cylinder axis 20 of the first cylinder bore 14 and of the second cylinder bore 16 forms a transition from the first cylinder bore 14 to the second cylinder bore 16.

There is arranged in the first cylinder bore 14 and the second cylinder bore 16 coaxially with the cylinder axis 20 a stepped piston designated in its entirety 24 having a first piston section 26 extending into the first cylinder bore 14 and a second piston section 28 extending into the second cylinder bore 16. A step between the first piston section 26 and the second piston section 28 is formed by a ring surface 30.

The stepped piston 24 is of such dimensions that at its top dead center, the first piston section 26 is arranged with its piston bottom 32 opposite the second piston section 28 at a short distance from the cylinder bottom 12 and the ring surface 30 of the stepped piston 24 is slightly spaced from the ring surface 22 of the cylinder housing 10.

At the bottom dead center the piston bottom 32 is at the maximum distance from the cylinder bottom 12, and similarly the ring surface 30 from the ring surface 22. The stepped piston 24 is still guided by the cylinder bores 14 and 16 at the bottom dead center, too.

The stepped piston 24 is guided in the cylinder bores 14 and 16 via a first gas film 34 which forms between the first cylinder bore 14 and a circumferential surface 36 of the first piston section 26 as well as via a second gas film 40 which forms between the second cylinder bore 16 and a circumferential surface 38 of the second piston section 28. These two gas films 34 and 40 carry the stepped piston 26 in all positions and so the latter does not touch the cylinder bores 14 and 16 of the cylinder housing 10 at all.

A first compression space 42 is formed by the cylinder bottom 12, the region of the first cylinder bore 14 adjoining the latter as far as the piston bottom 32 and by the piston bottom 32. A supply pipe 44 for cryogenic hydrogen opens into the first compression space 42 near the cylinder bottom 12 and can be closed off from the first compression space 42 by an inlet valve 46. Furthermore, a pressure pipe 47 for the cryogenic hydrogen subjected to pressure in the first compression space 42 extends away from the cylinder bottom 12 and can be closed off from the first compression space 42 by an outlet valve 48.

A second compression space 50 is formed by the ring surface 22, the ring surface 30 of the stepped piston 24 and the sections of the circumferential surface 36 of the first piston section 26 extending between these two as well as by the second cylinder bore 16. A branch pipe 52 branching off from the supply pipe 44 opens into the second compression space 50, preferably in the region of the ring surface 22. The branch pipe 52 has a one-way valve 54 which opens in the direction of flow to the second compression space 50.

In the first embodiment according to FIG. 1, the supply pipe 44 and the branch pipe 52 are formed at least partly by bores in the cylinder housing 10.

To form a buffer volume 56 for the first gas film 34, the first cylinder bore 14 has approximately half way between the ring surface 22 and the piston bottom 12 a ring space 58 which extends radially outwardly into the cylinder housing 10 with respect to the cylinder axis 20. This ring space is preferably defined so as to correspond approximately to the volume of the first gas film 34.

To enable at least partial heating of the gas forming in the first gas film 34, a heating jacket 60 is provided between the ring space 58 and the ring surface 22 in the cylinder housing 10 for heating a wall 62 forming the first cylinder bore 14 between the ring space 58 and the ring surface 22. The heating jacket is preferably formed by a channel 64 which extends in the cylinder housing 10 around the portion in question of the first cylinder bore 14 and through which a heating medium 66, such as, for example, hot water, can flow, and so the wall 62 can be heated to the temperature of the heating medium 66 and thereby also heats the portion of the first gas film 34 resting thereagainst.

The stepped piston 24 is driven via an eccentric 68 driven by a motor, not illustrated in the drawings, and a connecting rod 70 which is mounted for rotation on both the stepped piston 24 and the eccentric 68.

The first embodiment of the inventive cryogas pump functions as follows:

The rotating eccentric 68 causes the stepped piston 24 mounted by the gas films 34 and 40 in the cylinder bores 14 and 16 to execute linearly oscillating motions along the cylinder axis 20 between the top dead center and the bottom dead center. During an expansion motion of the stepped piston 24, the first compression space 42 expands and so cryogenic hydrogen flows into the first compression space 42 via the supply pipe 44 and the inlet valve 46 and leaves the first compression space 42 via the outlet valve 48 and the pressure pipe 47 during the compression motion of the stepped piston 24. In the supply pipe 44, there is normally a pressure of 1.5 MPa which is preferably maintained by a precompressor. In the pressure pipe, pressures in the range of from 10 to 20 MPa are reached. The temperature of the cryogenic hydrogen in the supply pipe 44 is preferably approximately 35K, and, in like manner, the temperature in the pressure pipe 47.

In addition to the first compression space 42, the second compression space 50 is also enlarged during the expansion motion of the stepped piston 24 and so cryogenic hydrogen can also flow into it via the branch pipe 52 and the one-way valve 54 from the supply pipe 44 at the pressure existing therein. The hydrogen which flows into the second compression space is heated to a temperature of the order of magnitude of 200K.

During the compression motion, the hydrogen in the second compression space 50 is prevented from flowing back to the supply pipe 44 via the branch pipe 52 owing to the one-way valve 54 and will, therefore, bring about a flow of gas in this gas film 34 along the wall 62 in the direction of the first compression space 42. As it flows along the wall 62, this flow of gas is heated up by the wall 62 heated by the heating jacket 60, enters the buffer volume 56 of the ring space 58 in the heated state and then flows from the buffer volume 56 to the first compression space 42, thereby forming a flow of gas continuing through the first gas film 34.

This flow of gas forming during the compression motion in the direction of the first compression space 42 in the first gas film 34 prevents a flow of cold gas from occurring in the first gas film 34 away from the first compression space 42 and from cooling the first piston section 26 and the first cylinder bore. On the contrary, the first piston section 26 and the first cylinder bore 14 are "kept warm" in their section remote from the first compression space 42 and so a short structural length of the first piston section 26 and the corresponding first cylinder bore 14 is possible and the piston 24 can be kept at temperatures of the order of magnitude of 200 to 300K on the driven side. In the embodiment according to FIG. 1, this was achieved with a length of the first piston section 26 of the order of magnitude of 70 mm, with the first gas film 34 having a thickness of approximately 5 $\mu$m.

In a second embodiment of the inventive cryogas pump, illustrated in FIGS. 2 and 3, the same reference numerals are used insofar as the same parts as used as in the first embodiment. Therefore, reference is to be had to the statements on the first embodiment for a description of these parts.

In a modification of the first embodiment, an intermediate part 72 is held on the side of the stepped bore 24 facing the crankshaft space 18. The intermediate part 72 has a recess 74 which extends transversely to the cylinder axis 20 and in which a crankpin 76 of a crankshaft engages. In its extent transversely to the cylinder axis 20, the recess 74 is of such dimensions that the crankpin 76 can move freely therein without its motion in this transverse direction being obstructed. In the direction of the cylinder axis 20, the recess 74 has a width which corresponds to the diameter of the crankpin 76 so the intermediate part 72 is moved up and down in the direction of the cylinder axis 20 when the crankshaft rotates. On the side of the intermediate part 72 opposite the second piston section 28, there is a third piston section 78 which is aligned coaxially with the cylinder axis 20 and is movable up and down in a third cylinder bore 80 which is likewise provided in the cylinder housing 10.

The third piston section 78 has a piston bottom 82 which stands perpendicularly on the cylinder axis 20, and the third cylinder bore 80 has a cylinder bottom 84 which likewise extends perpendicularly to the cylinder axis 20. A third compression space 86 is delimited by the cylinder bottom 84, the region of the third cylinder bore 80 extending as far as the piston bottom 82 and by the piston bottom 82. This third compression space 86 is reduced or increased in size conversely to the first and second compression spaces 42 and 50, respectively, and serves as forepump for the second compression space 50. In order to supply the third compression space with hydrogen gas, a branch pipe 88 leads from the supply pipe 44 into the crankshaft space 18, and an entrance gap 90 opens from this crankshaft space 18 into the third compression space 86, this entrance gap 90 being arranged such that hydrogen gas can flow into the third compression space when the piston bottom 82 is at the top dead center.

There, furthermore, extends from the piston bottom 82 through the third piston section 78, the intermediate part 72 and the second piston section 28 an overflow channel 92 which exits from the second piston section in the region of the ring surface 30 and is provided with an inflow valve 94 for the second compression space 50. The entire piston 96 formed by the stepped piston 24, the intermediate part 72 and the third piston section 78, in the second embodiment of the inventive cryogas pump, is either likewise mounted by the first gas film 34 and the second gas film 40 as well as by a third gas film 98 between the third cylinder bore 80 and a circumferential surface 100 of the third piston section 78 (FIG. 2) or by piston packings 41 and 99 with dry operating characteristics arranged between the second cylinder bore 16 and the circumferential surface 38 as well as between the third cylinder bore 80 and the circumferential surface 100 (FIG. 3).

In both cases, the advantage of the second embodiment is to be seen in the fact that the entire piston 96 is mounted on both sides opposite the intermediate part 72 and hence the point of engagement of the crankpin 76 and, therefore, has a lesser tendency to tilt.

In addition, the mounting of the entire piston 96 on both sides with respect to the point of engagement of the crankpin 76 was used to create a forepump stage for the second compression space 50.

The second embodiment functions as follows: During the expansion motion of the entire piston 96, hydrogen gas is compressed in the third compression space 86, flows under pressure through the overflow channel 92 and the inflow valve 94 into the second compression space 50, is compressed therein during the compression motion of the entire piston 96, whereby the flow of gas is created in the first gas film 34. At the same time, during the compression motion of the entire piston 96, a pressure below atmospheric is generated in the third compression space 86 and at the top dead center of the entire piston 96 results in an influx of hydrogen gas through the entrance gap 90 from the crankshaft space 18, which, for its part, is in communication with the supply pipe 44 via the branch pipe 88 and hence is constantly supplied with hydrogen.

The second embodiment has the further advantage that owing to the fact that both the third cylinder bore 80 and the second cylinder bore 16 open into the crankshaft space 18, a tolerable leakage may occur between the third compression space 86 and the second compression space 50 in the direction towards the crankshaft space, as the hydrogen gas is constantly taken from the crankshaft space 18 through the entrance gap 90 via the forepump stage formed by the third compression space 86, and the crankshaft space 18 is kept at the same pressure as the supply pipe 44 via the branch pipe 88.

The present disclosure relates to the subject matter disclosed in German application No. P 39 07 728.4 of Mar. 10, 1989, the entire specification of which is incorporated herein by reference.

What is claimed is:

1. Cryogas pump, in particular, a cryogas pump for cryogenic hydrogen fit for use in vehicles, comprising a cylinder housing and a piston which forms with said cylinder housing a first compression space for the cryogenic gas and which is mounted with a first piston section adjacent to said first compression space by a gas film in said cylinder housing, said cryogas pump having a second compression space with which said gas film is in communication and by means of which a flow of gas can be generated in said gas film in the direction of said first compression space.

2. Cryogas pump as defined in claim 1, characterized in that said gas film has a temperature above 200K in its section facing away from said first compression space.

3. Cryogas pump as defined in claim 1, characterized in that said flow of gas can be generated during compression in said first compression space.

4. Cryogas pump as defined in claim 1, characterized in that said piston comprises said first piston section for formation of said first compression space and a second piston section for formation of said second compression space.

5. Cryogas pump as defined in claim 4, characterized in that said piston is designed as a stepped piston.

6. Cryogas pump as defined in claim 1, characterized in that said gas film is provided with a buffer volume.

7. Cryogas pump as defined in claim 6, characterized in that said buffer volume is formed by a ring space surrounding said first piston section.

8. Cryogas pump as defined in claim 1, characterized in that said gas for said gas film can be warmed up.

9. Cryogas pump as defined in claim 8, comprising means for heating said gas film above the temperature of said warmed up gas.

10. Cryogas pump as defined in claim 9, wherein said heating means heat said gas film in its section facing said second compression space.

11. Cryogas pump as defined in claim 10, characterized in that said gas film is provided with a buffer volume and that said gas film can be heated between said second compression space and said buffer volume.

12. Cryogas pump as defined in claim 1, characterized in that a third compression space is provided as precompression space for said second compression space.

13. Cryogas pump as defined in claim 12, characterized in that said third compression space is operable in phase opposition to said second compression space.

14. Cryogas pump as defined in claim 12, characterized in that said piston has a third piston section which forms with said cylinder housing said third compression space.

15. Cryogas pump as defined in claim 14, characterized in that said first and third piston sections are arranged at opposite ends of said piston.

16. Cryogas pump as defined in claim 14, characterized in that a piston drive means engages said piston between said first and third piston sections.

17. Cryogas pump as defined in claim 16, characterized in that said piston drive means comprises an eccentric.

18. Cryogas pump as defined in claim 17, characterized in that an eccentric pin engages an eccentric recess extending transversely to the direction of motion of said piston (96).

19. Cryogas pump as defined in claim 12, characterized in that said piston is mounted by a gas film between said second compression space (50) and said third compression space.

20. Cryogas pump as defined in claim 12, characterized in that said piston is mounted by piston packings with dry operating characteristics between said second and said third compression spaces.

* * * * *